United States Patent [19]

Ogura et al.

[11] Patent Number: 4,922,994

[45] Date of Patent: May 8, 1990

[54] APPARATUS FOR POURING MOLTEN STEEL INTO A MOLD IN CONTINUOUS CASTING OF STEEL

[75] Inventors: Yasutsugu Ogura; Ryuichi Maeda, both of Tokyo, Japan

[73] Assignee: NKK Corporation, Tokyo, Japan

[21] Appl. No.: 261,587

[22] Filed: Oct. 24, 1988

[30] Foreign Application Priority Data

Nov. 6, 1987 [JP] Japan ..... 62-169782[U]

[51] Int. Cl.[5] ..... B22D 11/10

[52] U.S. Cl. ..... 164/437; 164/337; 222/602

[58] Field of Search ..... 164/133, 337, 437, 488; 222/590, 597, 602

[56] References Cited

U.S. PATENT DOCUMENTS

| | | | |
|---|---|---|---|
| 2,472,456 | 6/1949 | Anicetti | 432/265 |
| 3,459,209 | 8/1969 | Kobusch et al. | 222/597 |
| 3,511,304 | 5/1970 | Baier et al. | 164/437 |
| 3,730,401 | 5/1973 | Bode, Jr. | 164/437 |
| 4,526,349 | 7/1985 | Schwer | 266/45 |

FOREIGN PATENT DOCUMENTS

| | | | |
|---|---|---|---|
| 0270418 | 6/1988 | European Pat. Off. . | |
| 1535859 | 8/1968 | France . | |
| 60-210352 | 10/1985 | Japan | 164/133 |
| 517542 | 2/1972 | Switzerland | 164/437 |

OTHER PUBLICATIONS

Iron and Steelmaking, No. 1, 1981, pp. 39–42; M. Saigusa et al.: "New Method for Limiting Slag Carry-over Into Steel Ladle" *FIGS. 1–4; p. 39, right-hand col.–p. 40, left-hand col.

*Primary Examiner*—Richard K. Seidel

*Attorney, Agent, or Firm*—Frishauf, Holtz, Goodman & Woodward

[57] ABSTRACT

An apparatus for pouring molten steel into a mold in continuous casting of steel according to the present invention comprises a tundish holding molten steel; a nozzle which is set at the bottom of said tundish, the nozzle having a spherical shape and through which molten steel flows out of said tundish; a sliding plate which is set at the lower portion of said nozzle and which opens and closes said nozzle; an immersion nozzle which is set under said sliding plate and through which molten steel is poured into the mold; and a block body which has a core body therein, whose outer layer is made from refractory material and has a spherical surface large enough to cover the opening of said nozzle and whose bulk specific gravity ranges between the bulk specific gravity of slag and that of molten steel. A disc-shaped flange is coupled to the spherical surface portion.

10 Claims, 2 Drawing Sheets

APPARATUS FOR POURING MOLTEN STEEL INTO A MOLD IN CONTINUOUS CASTING OF STEEL

BACKGROUND OF THE INVENTION

1. Field of the Invention

The present invention relates to an apparatus for pouring molten steel from a tundish into a mold in continuous casting of steel.

2. Description of the Prior Art

In continuous casting of steel, molten steel is poured into a tundish from a ladle and further into a mold through a nozzle. In this case, when the level of the molten steel in the tundish goes down at the last stage of casting, the molten steel right over the nozzle flows out of the nozzle, producing an eddy which has a possibility of entangling slag on the surface of the molten steel. If the molten steel including the slag is poured into the mold, there can be increased defects produced by non-metallic inclusions in steel manufactured from slab made by means of continuous casting of steel. To prevent the slag from being entangled in the molten steel, said nozzle is closed before said eddy occurs to stop an inflow of the molten steel into the mold.

SUMMARY OF THE INVENTION

It is an object of the present invention to provide an apparatus for pouring molten steel into a mold in continuous casting of steel, wherein the occurrence of an eddy in molten steel or slag is prevented at the last stage of continuous casting; an inflow of the slag together with the molten steel from a tundish into a mold is avoided and the yield of the molten steel is increased by reducing a residual amount of the molten steel as much as possible.

To accomplish said object, the apparatus for pouring molten steel into a mold in continuous casting of steel comprises.

a tundish holding molten steel;

a nozzle which is arranged at the bottom of said tundish, the nozzle having a spherically shaped opening and through which molten steel flows out of said tundish;

a sliding plate which is set at the lower portion of said nozzle and which opens and closes said nozzle;

an immersion nozzle which is set under said sliding plate and through which molten steel is poured into the mold; and a block body which has a core body therein, whose outer layer is made from refractory material and has a spherical surface portion large enough to cover the opening of said nozzle and whose bulk specific gravity ranges between bulk specific gravity of slag and that of molten steel. A disc-shaped flange is coupled to the spherical surface portion.

The above objects and other objects and advantages of the present invention will become apparent from detailed description to follow, taken in conjunction with the appended drawings.

DESCRIPTION OF THE PREFERRED EMBODIMENT

Figure 1:
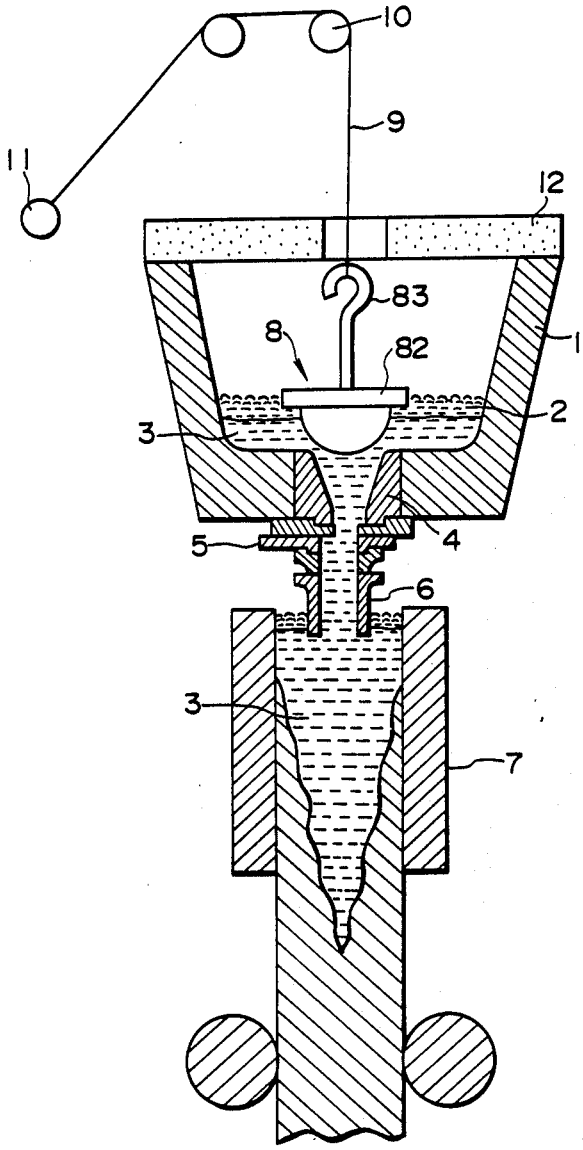
FIG. 1 is a longitudinal sectional view illustrating an apparatus for pouring molten steel into a mold in continuous casting of steel of the present invention.

When the amount of molten steel in a tundish decreases and the level of the molten steel goes down at the last stage of continuous casting of steel, an eddy is produced by a flow of the molten steel flowing out of a nozzle arranged at the bottom of the tundish and slag included in the molten steel can often flow in a mold together with the molten steel. The slag having flowed in the mold can remain in the slab or on the surface of the slab as non-metallic inclusions and can be a cause of serious defects of products. In consequence, to prevent the slag from flowing out of said nozzle, the nozzle is conventionally closed at a level of the molten steel at which said eddy does not occur and the continuous casting of steel is stopped. Then, entanglement of the slag in the molten steel is prevented. The molten steel which remains in the tundish, however, converts not to slab, but to scrap. This, of course, leads to a decrease of the yield of the product.

The apparatus for pouring molten steel into a mold in continuous casting of steel of the present invention, which is made to overcome said difficulties, has a block body provided with a spherical surface made from refractory material and being large enough to cover an opening for said nozzle in the tundish. The bulk specific gravity of the block body is smaller than that of the molten steel and larger than that of the slag. In consequence, the block body floats on the molten steel. The spherical surface of said refractory material is large enough to close the nozzle by fitting in the opening of the nozzle. The apparatus for pouring molten steel into a mold in continuous casting of steel is used at the last stage of continuous casting of steel. The block body is put nearly at a molten steel-slag interface by a charging means arranged separately out the tundish and floats there.

To use said block body inside the tundish, a stopper which opens and closes a passage for an inflow of the molten steel from the tundish into the mold and which controls a flow of the molten steel is not up-and-down type stopper which opens and closes said opening by an up-and-down movement, being inside the tundish, but a slide type stopper which opens and closes the passage for a flow of the molten steel by a movement of a sliding plate in the horizontal direction, being at the lower portion of the nozzle.

The block body constituted as mentioned above goes down with sinking of the level of the molten steel at the last stage of continuous casting and is led to a portion nearly right over the nozzle by a flow of the molten steel flowing in the mold. Accordingly, there does not occur any eddy in connection with the flow of the molten steel as seen conventionally. When a residual amount of the molten steel in the tundish decreases and the block body stops floating, said block body reaches the bottom of the tundish and fits in the nozzle. And the nozzle is closed. Accordingly, the residual amount of the molten steel is decreased in comparison with a prior art apparatus.

An example of the present invention will now be explained with specific reference to the appended drawings.

FIG. 1 is a longitudinal sectional view illustrating an example of the present invention. In the drawings, referential numeral 1 denotes a tundish, 2 slag, 3 molten steel, 4 a nozzle, 5 a sliding plate, 6 an immersion nozzle, 7 a mold, 8 a block body, 81 semispherical refractory member, 82 a refractory flange, 83 a hook, 9 a wire, 10 a roller through which the wire moves, 11 a handle charging said block body 8 into the tundish by means of the wire, 12 a cover of the tundish. Wire 9, roller 10 and handle 11 constitute the charging means.

Figure 2:
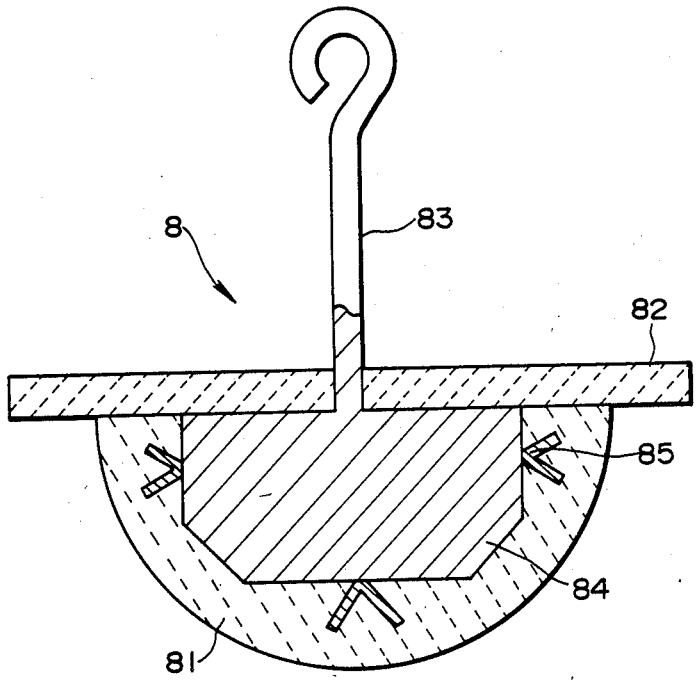
FIG. 2 is an enlarged sectional view illustrating a block body of said apparatus in FIG. 1.

FIG. 2 is an enlarged sectional view illustrating block body 8. Block body 8 comprises semi-spherical refractory member 81, flange 82 on semi-spherical refractory member 81, core body 84 set inside semi-spherical member 81 for controlling bulk specific gravity so that the bulk specific gravity of block body 8 can be of a favorable value, Y-stud 85 connected by welding to core body 84 and hook 83 extending over flange 82. The operation of the apparatus for pouring molten steel into a mold in continuous casting of steel constituted in such a manner will now be explained.

When the level of the molten steel in tundish 1 goes down at the last stage of continuous casting of steel and reaches a predetermined position, block body 8 connected to wire 9 passing through roller 10 is made to go down to a position right over nozzle 4 by operating handle 11. Said wire 9 is prepared so that it can be cut by melting in a high temperature atmosphere. In consequence, block body 8 alone floats nearly at an interface of slag 2 and molten steel 3. Because of said constitution of block body 8, the bulk specific gravity of block body 8 is smaller than that of the molten steel and larger than that of the slag. Therefore, block body 8 goes down with sinking of the level of the molten steel. In this example, said bulk specific gravity of block body 8 is from 3.0 to 6.0. If the bulk specific gravity of block body 8 is less than 3.0, the floating block body does not move along a flow of the molten steel being influenced by a movement of the slag, and goes away from the position right over the nozzle. In consequence, there is a possibility that block body 8 does not work well to close the nozzle at the last stage of continuous casting of steel. If the fluidity of the slag is not good, block body 8 does not move along the flow of the molten steel and has a possibility of being sealed up in the slag. Accordingly, the fluidity of the slag is desired to be increased. If said bulk specific gravity of block body 8 is over 6.0, block body has a possibility of going down under the influence of the flow of the molten steel, of coming in contact with the bottom of the tundish and of hindering the casting work.

Flange 82 positioned on block body 8 has a function of stabilizing a central axis of block body 8 and of preventing the occurrence of the eddy at the same time. The diameter of the flange is made to be larger than the diameter of the spherical layer of the block body and is large enough to prevent an eddy from being produced.

Said block body can have a spherical shape. In this case, the block body has an advantage in that there is no need of taking into consideration an attitude of the block body floating inside the tundish. On the other hand, the spherical surface of the block body needs to be enlarged to prevent the occurrence of the eddy. Therefore, the weight of the spherical block body is inevitably larger than that of the semi-spherical block body.

When the inflow of the molten steel from the tundish into the mold proceeds and the level of the molten steel lowers, block body 8 goes down, reaches the bottom of the tundish and fits in nozzle 4. In consequence, nozzle 4 is closed.

Basic refractory material containing 60% magnesia or more is used for the outer layer of block body 8 so as to let the outer layer of block body 8 have a corrosion resistance to the slag. This refractory material has to withstand the use of the block body at least once. Castable or sintered material, however, is desired to be used, the life span and the cost of the refractory material which is expected to be used twice or more being taken into consideration. If the refractory material contains less than 60% magnesia, said corrosion resistance of the refractory material is not sufficient. In case the refractory material is corroded, the block body does not fit well in the nozzle when the nozzle is closed and this leads possibly to the leakage of the molten steel.

A radius of curvature of the spherical surface at the end of block body 8 is determined experimentally relative to nozzle 4 and desired to be of from 0.7 to 3.0 of the diameter of the nozzle. If the radius of curvature of the spherical surface is less than 0.7 of the diameter of the nozzle, it is difficult to prevent the occurrence of the eddy in case the block body is spherical. In case the block body has a semi-spherical shape with a radius of curvature less than 0.7 and flange 82 is large in size enough to prevent the occurrence of the eddy, the attitude of the floating block body is unstable because flange 82 and the semi-spherical shape are not balanced. If said radius of curvature of the block body is over 3.0 of the diameter of the nozzle 4, the block body has a possibility of not fitting in nozzle 4 due to the inclusions deposited to the portion close to nozzle 4 when the block body reaches the bottom of the tundish. In order that a flow velocity of the molten steel can be strong enough to lead block body 8 to the position of nozzle 4, to let block body 8 reach the bottom of the tundish and to let block body 8 fit in nozzle 4 at the last stage of continuous casting of steel when the residual amount of the molten steel is small, it is effective to make the bottom of tundish 1 be inclined toward the opening of the nozzle. If the surface of the bottom inside the tundish is inclined toward the opening of nozzle 4 at less than 10° to the horizontal plane, the flow velocity of the molten steel is not sufficiently strong. An angle of the incline more than 30° produces some influence on the cost of manufacturing tundish 1.

EXAMPLE

The radius of semi-spherical refractory member 81 was 90 mm. The diameter of flange 82 was 240 mm. Core body 84 inside the block body was of a cylindrical shape whose diameter was 140 mm. Hook 83 was connected by welding to core body 84.

The capacity of the tundish was 35 t. When the depth of the molten steel was 400 mm or less (one-third of the tundish or less), block body 8 went down and floated nearly at an interface of molten steel 3 and slag 2 by operating handle 11.

When block body 8 reached the bottom of the tundish and nozzle 4 was closed, the depth of the molten steel was 50 mm. At this time, the residual amount of the molten steel was 0.5 t and an outflow of the slag was not seen entirely.

In a prior art example, when the depth of molten there was 200 mm or less, a nozzle was closed because there was a possibility that slag was entangled in a produced eddy and flowed in a mold. When the nozzle was closed, the residual amount of the molten steel in the tundish was from 3 to 4 t.

What I claim is:

1. An apparatus for pouring molten steel into a mold in continuous casting of steel, comprising:

a tundish for holding molten steel;

a first nozzle arranged at the bottom of said tundish, said first nozzle having a spherical shape opening through which molten steel flows out of said tundish;

a sliding plate means mounted at a lower portion of said first nozzle for opening and closing said first nozzle;

an immersion nozzle arranged under said sliding plate means and having an opening through which molten steel is poured into the mold; and a block body having a core body therein, said block body including:

a semi-spherically shaped refractory member around at least a portion of said core body, said semi-spherically shaped refractory member being sufficiently large to cover said opening of said first nozzle, and said semi-spherically shaped refractory member having a radius of curvature of from 0.7 to 3 times the diameter of said opening of said first nozzle; and a substantially disc-shaped flange made from refractory material and coupled to an upper portion of said semi-spherically shaped refractory member and extending outwardly of said semi-spherically shaped refractory member; and said block body having a bulk specific gravity which ranges between the bulk specific gravity of slag and that of molten steel.

2. The apparatus of claim 1, wherein said block body further comprises a hook member extending upwardly from said flange.

3. The apparatus of claim 2, wherein said hook member is coupled to said flange.

4. The apparatus of claim 1, wherein the bulk specific gravity of said block body is from 3.0 to 6.0.

5. The apparatus of claim 1, wherein said semi-spherically shaped refractory member and said flange are made from a basic castable refractory material containing 60% or more of magnesia.

6. The apparatus of claim 1, wherein said tundish has a bottom inside surface which is inclined downward toward the opening of said first nozzle at from 10° to 30° relative to a horizontal plane.

7. The apparatus of claim 1, further comprising charging means for charging said block body into said tundish.

8. The apparatus of claim 7, wherein said charging means comprises a wire coupled to said block body, said wire being meltable in a high heat temperature atmosphere in said tundish so as to be cut by melting at said high heat temperature in said tundish.

9. The apparatus of claim 8, wherein said block body further comprises a hook member extending upwardly from said flange, said wire being coupled to said member for charging said block body into said tundish.

10. The apparatus of claim 1, wherein said substantially disc-shaped flange has a larger diameter than the maximum diameter of said semi-spherically shaped refractory member.

* * * * *